United States Patent [19]

Kurita et al.

[11] 4,009,958

[45] Mar. 1, 1977

[54] BELT SUPPORT STRUCTURE IN COPYING MACHINE

[75] Inventors: Takaji Kurita, Kawachinagano; Takao Fujiwara, Sakai, both of Japan

[73] Assignee: Minolta Camera Kabushiki Kaisha, Azuchi, Japan

[22] Filed: Mar. 19, 1975

[21] Appl. No.: 560,091

[30] Foreign Application Priority Data

Apr. 20, 1974 Japan ..... 49-44754

[52] U.S. Cl. ..... 355/16

[51] Int. Cl.[2] ..... G03G 15/00

[58] Field of Search ..... 355/3 R, 16, 3 BE

[56] References Cited

UNITED STATES PATENTS

| | | | |
|---|---|---|---|
| 3,520,604 | 7/1970 | Shelffo | 355/16 |
| 3,604,797 | 9/1971 | Szczesniak | 355/16 |
| 3,606,532 | 9/1971 | Shelffo et al. | 355/16 X |
| 3,619,050 | 11/1971 | Swanke | 355/16 |
| 3,796,488 | 3/1974 | Tanaka et al. | 355/16 |
| 3,797,930 | 3/1974 | Tanaka et al. | 355/16 X |
| 3,888,577 | 6/1975 | Meyer | 355/16 X |
| R27,776 | 10/1973 | Turner | 355/16 |

*Primary Examiner*—Fred L. Braun

[57] ABSTRACT

A belt support structure which telescopically movably supports a belt assembly in a photoelectrostatic copying machine. The belt support structure has first guide rails secured at at least two spaced points thereof to a wall or framework of the housing structure for the copying machine, second guide rails respectively telescopically movably mounted on the first guide rails and third guide rails telescopically mounted on the second guide rails. The third guide rails carry the belt assembly for pivotal movement between operative and released positions. When the belt assembly is in the released position outside the housing structure, replacement of the used photoreceptor belt, inspection, repair or cleaning of all operating elements of the copying machine arranged around the photoreceptor within the housing structure can be facilitated.

7 Claims, 6 Drawing Figures

BELT SUPPORT STRUCTURE IN COPYING MACHINE

The present invention generally relates to a photoelectrostatic copying machine of a type employing a photoreceptor imaging medium in the form of a substantially endless belt and, more particularly, to a photoreceptor belt support structure in the photoelectrostatic copying machine which is designed to facilitate replacement of the used photoreceptor belt.

In a known automatic photoelectrostatic copying machine utilizing a photoreceptor belt, the photoconductive recording surface on the photoreceptor belt being driven in one direction passes, during one complete turn, an electrostatic charging station at which a uniform electrostatic charge is placed on the recording surface; an imaging or exposure station at which an optical image is projected onto the recording surface from a stationary held original to be copied to produce an electrostatic latent image on the recording surface; a developing station at which the electrostatic latent image is rendered visible as a powder image formed on the recording surface by the use of fine particles of synthetic resin, that is, a so-called toner; a transfer station at which the powder image is transferred from the recording surface to a suitable support or recording medium; and a cleaning station at which residual powder is removed from the recording surface in readiness for the subsequent cycle of copying operation.

It is well known that, as the copying machine is repeatedly operated a number of times such that the electrostatic charge receptivity of the recording surface of the photoreceptor belt is considerably reduced, replacement of the used photoreceptor belt by a new one is required. A similar replacement is also required when the recording surface of the photoreceptor belt is spoiled, or otherwise scratched, to such an extent that the resultant reproduction of the original on the recording medium, such as a web of paper, is stained.

For the purpose of facilitation of the replacement referred to above, or for any other purpose, for example, repair or inspection of one or more operating elements arranged around the photoreceptor belt, most photoelectrostatic copying machines generally in use are designed such that a belt assembly, including the photoreceptor belt, at least one pair of support rolls around which the photoreceptor belt is operatively suspended and a support framework for the photoreceptor belt and support rolls, is movable out of a housing structure of the copying machine. More particularly, one type of conventional copying machine comprises a housing structure having an access opening adapted to be selectively closed and opened by a hingedly supported door, and a belt support structure including a substantially horizontally extending stationary guide having one end rigidly connected to an upright wall of the housing structure, which is opposed to the access opening, an intermediate guide telescopically movably mounted on the stationary guide and a support frame telescopically movably mounted on the intermediate guide and carrying the photoreceptor belt assembly.

In the conventional copying machine of the construction described above, when the photoreceptor belt assembly is to be telescopically drawn out of the housing structure, some of the operating elements, such as a developer at the developing station, an electrostatic charger at the charging station, a charger for the powder image transfer at the transfer station, a paper separator at the paper removing station and a cleaner at the cleaning station, have to be retracted away from the photoreceptor belt clearing a passage for the belt assembly of any possible obstructions which may otherwise exist in said passage. This is a very complicated and time-consuming procedure and, therefore, often hampers easy and ready removal of the belt assembly from the housing structure.

Moreover, since the stationary guide, which supports the total weight of the belt assembly and its associated parts, is cantilevered, a steady support of the belt assembly can hardly be attained and, in addition, undesirable stresses will be developed at the connection between the cantilevered stationary guide and the wall of the housing structure to which said stationary guide is secured, which stresses may be liable to fatigue breakage.

Accordingly, an essential object of the present invention is to provide an improved photoreceptor belt support structure in a photoelectrostatic copying machine, which facilitates easy and ready movement of the belt assembly out of the housing structure with substantial elimination of the disadvantages inherent in the conventional belt support structure.

Another object of the present invention is to provide an improved photoreceptor belt support structure of the type referred to above, wherein the belt assembly is hingedly mounted on a telescopically extensible belt support structure for facilitation of replacement of the used photoreceptor belt without being disturbed by the belt support structure.

A further object of the present invention is to provide an improved photoreceptor belt support structure of the type referred to above, wherein the belt assembly can be selectively removed from and inserted into the housing structure without necessitating the complicated and time-consuming procedure of retracting the operating elements of the copying machine which are arranged around and in the vicinity of the photoreceptor belt.

A still further object of the present invention is to provide an improved photoreceptor belt support structure of the type referred to above wherein the telescopically extensible belt support structure includes a substantially horizontally extending stationary guide supported at at least two spaced points within and by the housing structure so that the belt assembly can be supported steadily thereby.

A still further object of the present invention is to provide an improved photoreceptor belt support structure of the type referred to above, which does not damage or spoil the photoreceptor belt, even if the belt assembly is repeatedly removed from and inserted into the housing structure, and consequent improvement in the durability of the photoreceptor belt can be achieved.

A still further object of the present invention is to provide an improved photoreceptor belt support structure of the type referred to above, which can be manufactured at a relatively low cost without incuring an unreasonable increase of the price of the copying machine embodying the present invention.

In order to achieve the foregoing various objects, according to the present invention, there is provided a photoelectrostatic copying machine comprising a housing structure having an access opening on at least one side thereof, said access opening adapted to be selectively closed and opened by a hingedly supported door, said housing structure accommodating therein various mechanical, electrical and optical components of the photoelectrostatic copying system which, among them, include a belt assembly and a belt support structure.

The belt assembly comprises a pair of spaced side plates, at least one pair of drive and driven rolls each having both ends journalled to the respective side plates in spaced relation to each other and a substantially endless removable photoreceptor belt having one surface formed into a photoconductive recording surface, which photoreceptor belt is suspended between said drive and driven rolls. The drive roll has one rotatably extending through the corresponding side plate and in turn is connected with a clutch for engagement with and disengagement from a drive shaft operatively associated with a drive mechanism including an electrically operated motor and reduction gears. The driven roll is adjustable in a direction perpendicular to the longitudinal axis thereof and is normally biased in one direction so as to hold the photoreceptor belt under tension.

The photoreceptor belt herein disclosed is on the order of 200 microns in thickness and, in order to ensure a smooth movement of such a thin photoreceptor belt with no substantial slip between the photoreceptor belt and any of the drive and driven rolls, the photoreceptor belt is perforated on both side edge portions thereof on one hand and a chain drive system, including at least one substantially endless chain having equally spaced and outwardly extending projections for engagement into the perforations in the photoreceptor belt, is employed on the other hand.

To facilitate ready removal of the belt assembly from the housing structure without requiring some of the operating elements of the copying machine to be cleared of the recording surface of the photoreceptor belt, at least one of the side plates, which is remote from the access opening of the housing structure when said belt assembly is in the position in which it is accommodated within the housing structure, is made smaller than the outer cross sectional area defined by the outer sectional contour of the photoreceptor belt suspended between the drive and driven rolls.

The belt support structure for supporting the belt assembly for telescopic movement out of and from the housing structure comprises a first guide means secured to a wall of the housing structure and substantially horizontally extending in a direction perpendicular to the plane of the access opening of said housing structure and a second guide means telescopically movably mounted on said first guide means through a telescopically movable intermediate guide means, said first, intermediate and second guide means being arranged in such a manner that, when the belt assembly is to be removed from the housing structure, said intermediate and second guide means are sequentially extended from said first guide means. The belt assembly is hingedly supported by said second guide means by means of a plate means connected between the other side plate, which faces the access opening when said belt assembly is held within the housing structure, and said second guide means for pivotal movement about the hinge axis between an operative position in which the plane of the recording surface of the photoreceptor belt lies in substantially parallel relation to the plane of the belt support structure and a released position in which the plane of the recording surface of the photoreceptor belt lies at right angles to the plane of the belt support structure.

Removal or replacement of the used photoreceptor belt can be carried out when said belt assembly is held in the released position, in such a manner as to allow the photoreceptor belt to move across the side plate of the belt assembly which is remote from the access opening when said belt assembly is held within the housing structure. At this time, the tension imparted to the photoreceptor belt is lessened by adjusting the position of the driven roll.

These and other objects and features of the present invention will become apparent from the following description taken in conjunction with a preferred embodiment with reference to the accompanying drawings, in which.

Figure 1:
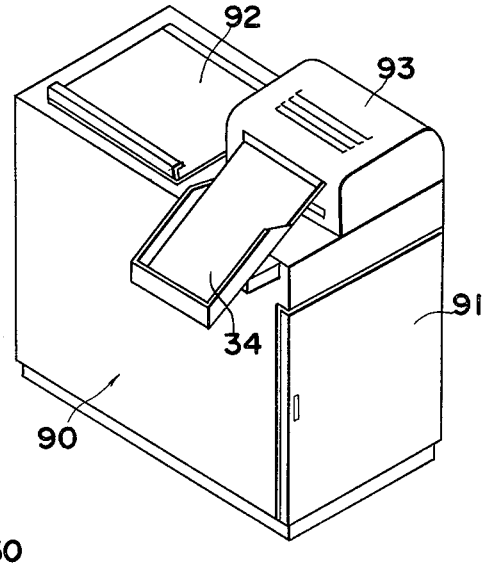
FIG. 1 is a schematic perspective view of a photoelectrostatic copying machine.

Referring first to FIG. 1, a photoelectrostatic copying machine comprises a housing structure, generally designated by 90, having at one side thereof an access opening leading into the interior of the housing structure, which access opening is adapted to be selectively closed and opened by a hingedly supported door 91. The housing structure 90 includes a flexible presser cover 92 for holding an original to be copied flat against the upper surface of a transparent support plate 7 (FIG. 2) mounted on the top of the housing structure 90, and a hood 93 mounted on the top of the housing structure 90 next to the presser cover 92, which hood 93 encircles a recording medium removal unit which will be described later. Diagonally frontwardly extending from the hood 93 is a tray 34 for receiving one or more sheets of recording medium on which copies have been made and which have consequently been removed from the removal unit.

Figure 2:
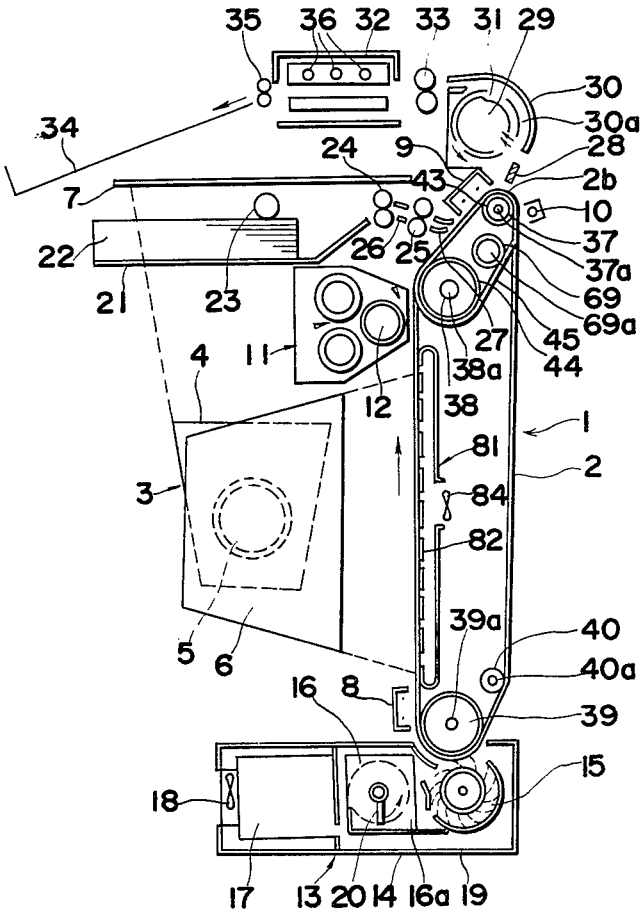
FIG. 2 is a side elevational view of the photoelectrostatic copying machine embodying the present invention.

As shown in FIG. 2, the copying machine comprises an optical system 3 including a source of light (not shown), for example, a xenon gas filled flash tube or any other suitable lamp, first and second reflective mirrors 4 and 6 and a lens assembly 5 capable of varying the copying ratio, which lens assembly 5 is supported in position between the first and second reflective mirrors 4 and 6. The copying machine further comprises a substantially endless photoreceptor belt 2 having a photoconductive recording surface and supported in such a manner as will be described later, which photoreceptor belt 2 is adapted to be driven in one direction, as designated by the arrow, to sequentially pass a plurality of processing stations including charging, exposure or imaging, developing, transfer and cleaning stations.

The charging station includes a corona charger 8 which applies a uniform electrostatic charge on the photoconductive surface of the photoreceptor belt 2. Positioned next and adjacent to the charging station with respect to the direction of movement of the photoreceptor belt 2 is the exposure or imaging station at which a light or radiation pattern of the original to be copied, which has been transmitted in order from the original on the transparent support plate 7, to the first reflective mirror 4, the lens assembly and the second reflective mirror 6 upon energization of the light source, is projected onto the photoconductive surface of the photoreceptor belt 2 to dissipate the electrostatic charge in the exposed area thereof thereby forming a latent electrostatic image of the original to be copied.

The exposed area on the recording surface of the photoreceptor belt 2 is, as the latter is driven, subsequently transferred to the developing station at which developing toner particles having an electrostatic charge opposite to that of the electrostatic latent image are applied, or otherwise cascaded in any known manner, over the recording surface of the photoreceptor belt 2 by a developer 11 to form a powder image in a configuration corresponding to the electrostatic latent image. In the illustrated embodiment, the developer 11 is a magnetic brush developer comprising a rotatable hollow cylindrical drum 12 having built-in magnets within the hollow of the drum, which drum forms magnetic brush bristles of the developing toner particles which are carried into contact with the electrostatic latent image to be developed.

Between the developing station and the transfer station, there is provided a paper feeding station including a sheet feeding mechanism adapted to feed sheets of paper successively to the photoreceptor belt 2 in coordination with the presentation of the developed image at said paper feeding station. This sheet feeding mechanism comprises a sheet supply tray 21 accommodating therein a stack of sheets of paper 22 which are fed one at a time by a feed roll 23 into a feed passage defined by a pair of spaced guides 26. The sheet feeding mechanism further comprises two sets of pairs of transfer rolls 24 and 25 adapted to be driven in association with the photoreceptor belt 2 so as to direct each sheet into contact with the moving photoreceptor belt 2 at a point immediately preceding the transfer station.

At the transfer station, there is provided a corona discharger 9 for effecting transfer of the developed image from the photoreceptor belt 2 to the sheet material in any known manner.

The sheet of paper, to which has been transferred the powder image from the photoconductive recording surface of the photoreceptor belt 2 at the transfer station, is thereafter removed from the photoreceptor belt 2 by a pick-up mechanism. This pick-up mechanism comprises one or more strip fingers 28 adapted to be brought into contact with the recording surface of the photoreceptor belt 2 slightly in advance of the sheet material and to strip the sheet material from said surface of said belt, directing the stripped sheet material onto a fixing mechanism 32 through a deflecting guide mechanism as will now be described.

The deflecting guide mechanism is a perforated rotary drum 29 having a plurality of perforations 31 each completely extending through the thickness of the cylindrical wall forming the rotary drum 29, the hollow interior of said rotary drum 29 in turn being communicated with a source of vacuum, and a curved deflector 30 which defines, in cooperation with the outer peripheral surface of said rotary drum 29, a passage **30*a* having one end opening immediately above and in the vicinity of the strip fingers 28 and the other end opening towards the fixing mechanism 32. It is to be noted that the rotary drum 29 is adapted to be driven in synchronism with the photoreceptor belt 2 in a direction, for example, counterclockwise, opposite to the direction of travel of the photoreceptor belt 2.**

The sheet material after having been stripped off the photoreceptor belt 2 by the strip fingers 28 and subsequently entering the passage **30*a* between the curved deflector 30 and the rotary drum 29 is fed towards the fixing mechanism with the back surface of said sheet material sucked flat against the peripheral surface of the rotary drum 29 by the effect of a pressure differential created by drawing air out of the interior of the rotary drum 29. The sheet material thus guided by the deflecting guide mechanism and emerging from the passage 30*a* travels through a pair of juxtaposed transfer rolls 33 onto the fixing mechanism 32. It is to be noted that one of the rolls 33 which contacts one of the surfaces of the sheet material which electrostatically carries the power image transferred thereto at the transfer station, is lined with insulated material. It is further to be noted that one or both of the transfer rolls 33 are driven in synchronism with the rotary drum 29 and, hence, the photoreceptor belt 2.**

The fixing mechanism fixes the developed and transferred image on the sheet material by conducting heat from an electric infrared lamp 36. The fixed sheet material is then fed onto the receiving tray 34 through a pair of juxtaposed drawing rolls 35.

The photoreceptor belt 2, from which the developed and transferred sheet material has been separated at the pick-up station, is subsequently transferred to the cleaning station past an erasing lamp 10 which removes the residual electrostatic charge on the photoconductive recording surface of the photoreceptor belt 2.

While the deflecting guide mechanism and the fixing mechanism 32 are both housed within the hood 93 on the top of the housing structure 90 of the copying machine, a cleaning unit provided at the cleaning station and having a construction as will be described later is arranged at the bottom of, or adjacent the bottom of, and within the housing structure 90. The cleaning unit 13 comprises a casing 14 accommodating therein a rotary brush 15 in rotatable and sliding contact with the lower turn of the photoreceptor belt 2, an electrostatic toner collector 16, a filter bag 17, a suction fan 18 arranged behind said filter bag 17 and an air passage 19 defined below the electrostatic toner collector 16 and around the cleaning brush 15 within the casing 14.

The electrostatic toner collector 16 has a plurality of equally spaced plate electrodes **16*a*, the adjacent pairs of which are adapted to be applied with respective potentials of different polarity so that the residual toner particles, which have been removed from the recording surface of the photoreceptor belt 2 by the clockwisely rotating brush 15 and subsequently fed to said collector 16 by the flowing air created by the rotation of said brush 15, are electrostatically collected, thereby adhering to the plate electrodes 16*a*. The suction fan 18 may not be always necessary, but where it is employed as is the case of the illustrated embodiment, operation of said suction fan 18 is such as to collect into the filter bag 17 a portion of the residual toner particles which has not been collected by the collector 16. The toner particles electrostatically built up on the plate electrodes 16***a* are removed from the plate electrode surfaces by rotating scrapers 20 which rotate in contact with the respective surfaces of the plate electrodes. Rotation of the scrapers 20 may be effected by an electrically operated motor operable in response to an electric signal generated by a suitable circuit (not shown) upon counting a certain number of sheet on which copies have been made.

The toner particles removed from the collector 16 in the manner as hereinabove described are in turn collected by a suitable container (not shown) disposed immediately below said collector 16.

The arrangement and operation of the copying machine thus far described are well known to those skilled in the art.

The details of the belt assembly 1 are best shown in FIGS. 3 to 6 and, therefore, reference will now be made thereto.

Figure 3:
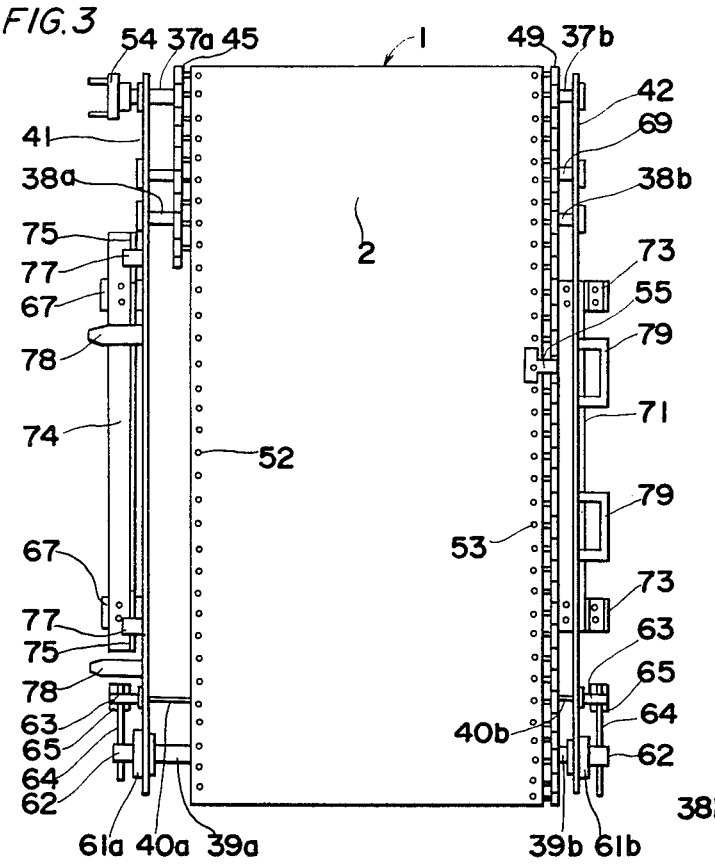
FIG. 3 is a front elevational view, on an enlarged scale, of a photoreceptor belt assembly employed in the copying machine of FIG. 2.
Figure 4:
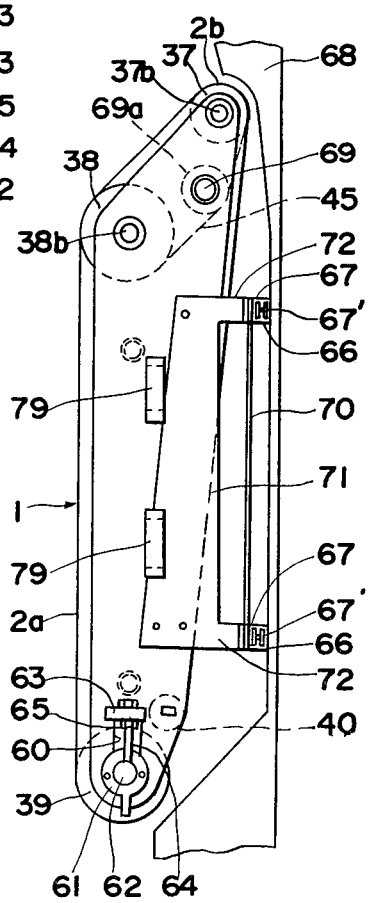
FIG. 4 is a schematic side view of the photoreceptor belt assembly shown in FIG. 3.

Referring first to FIGS. 3 and 4, the belt assembly 1 comprises a pair of spaced side plates 41 and 42 connected each other by means of a plurality of suitable bracings (not shown) all extending across the photoreceptor belt 2 and within a space inside said belt 2. Between these side plates 41 and 42, there are provided a drive roll 37, a deflecting roll 38, a driven roll 39, a tensioning roll 40 and a tensioning shaft 69. Each of the rolls 37 to 40 has both ends reduced in diameter to provide shafts 37*a* and 37*b*, 38*a* and 38*b*, 39*a* and 39*b* and 40*a* and 40*b*, respectively.

The drive roll 37 is held between the side plates 41 and 42 at a position adjacent the transfer station in such a manner that the shaft 37*b* is rotatably journalled in the side plate 42 while the shaft 37*a* rotatably and nonaxially movably extends through the side plate 41, a free end of which shaft 37*a* having rigidly mounted thereon a coupling 54 having a function which will be described later.

The deflecting roll 38 is held between the side plates 41 and 42 at a position followed by the developing station in such a manner that both of the shafts 38*a* and 38*b* are rotatably journalled in the respective side plates 41 and 42 and is positioned so that a portion of the photoconductive recording surface of the photoreceptor belt 2, which is at the exposure or imaging station, can be held flat with the plane thereof lying at right angles to the incoming light reflected from the second reflective mirror 6.

The driven roll 39 is adjustably supported between the side plates 41 and 42 at a position adjacent the cleaning station in such a manner that the shafts 39*a* and 39*b* are rotatably received by respective bearings 61*a* and 61*b* which are slidably accommodated in slots formed in the side plates 41 and 42. One of said slots which is formed in the side plate 42 is designated by 60 in FIG. 4. Free ends of these shafts 39*a* and 39*b* of the driven roll 39 are in turn associated with respective tension adjusting mechanisms of the same construction which will be described later.

The tensioning roll 40 is adjustably supported between the side plates 41 and 42 at a position preceding the cleaning station with the shafts 40*a* and 40*b* loosely journalled in the respective side plates 41 and 42, so that the photoreceptor belt 2 suspended around the drive roll 37, the deflecting roll 38 and the driven roll 39 can be held under tension. It should be understood that this tensioning roll 40 is biased by one or more spring elements (not shown) in a direction perpendicular to the longitudinal axis thereof so as to constantly impart a tension to the photoreceptor belt 2.

The tensioning shaft 69 is supported between the side plates 41 and 42 in a substantilly similar manner to the tensioning roll 40 and has a sprocket wheel 69*a* mounted thereon adjacent the side plate 41, the function of said sprocket wheel 69a being described later.

Figure 5:
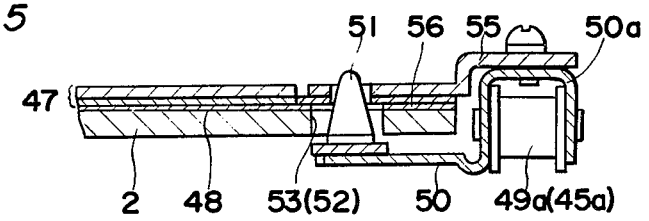
FIG. 5 is a cross sectional view, on an enlarged scale, of a portion of the photoreceptor belt assembly, as viewed in a direction perpendicular to the direction of travel of the photoreceptor belt shown in FIG. 3.

In the illustrated embodiment, the photoreceptor belt 2 is approximately 200 microns in thickness and has in both side edge portions a plurality of perforations 52 and 53. For driving the photoreceptor belt 2 without any slip between the belt 2 and at least the drive roll 37, a pair of substantially endless chains 45 and 49 are employed. One of the chains 45 is suspended around a sprocket wheel 43 rigidly mounted on the shaft 37*a* of the drive roll 37, a sprocket wheel 44 rigidly mounted on the shaft 38*a* of the deflecting roll 38 and the sprocket wheel 69*a* on the tensioning shaft 69, which shaft 69 imparts a tension to said chain 45 through said sprocket wheel 69*a*, while the other chain 49 is suspended around a sprocket wheel rigidly mounted on the shaft 37*b* of the drive roll 37, a sprocket wheel rigidly mounted on the shaft 38*b* of the deflection roll 38, a sprocket wheel rigidly mounted on the shaft 39*b* of the driven roll 39 and a sprocket wheel rigidly mounted on the shaft 40*b* of the tensioning roll 40 between it and the side plate 42. As best shown in FIG. 5, each of the chains 45 and 49 is composed of a plurality of substantially U-shaped links 50*a* connected to each other by pins 45*a* or 49*a* and each extending between opposed portions of any of the links 50*a* and has arms 50 integrally formed with said links 50*a*, each of which arms 50 extends in a widthwise direction of the photoreceptor belt 2 and has mounted thereon an upwardly tapered pin 51 for engagement in any of the perforations 52 or 53.

It will readily be seen that, as the drive roll 37 is rotated in a manner as will be described later, the rotational force of said drive roll 37 is transmitted first to said chains 45 and 49 and then to the photoreceptor belt 2 through the pins 51 carried by said chains 45 and 49 and engaged in said perforations 52 and 53, respectively, thereby moving the photoreceptor belt 2 in one predetermined direction as indicated by the arrow line in FIG. 2.

It is to be noted that, as best shown in FIG. 5, one of the links of the chain 49 situated adjacent the side plate 42 has an electrically conductive feeler 55 rigidly mounted on a portion of said link 50*a* which overhangs the associated pins 49*a*, which feeler 55 is made of an electrically conductive, flexible material and is in sliding contact with the photoreceptor belt 2. More particularly, the photoreceptor belt 2 has a photoconductive layer 47, made of a ply of polyvinyl carbazole and a ply of selenium, applied thereto through a vapor-bonded electroconductive layer 47 and, therefore, in order for the electroconductive layer 48 to be grounded, the flexible feeler 55 is positioned such as to connect the electroconductive layer 48 of the belt 2 through an electroconductive coating 56, which is electrically connected to the electroconductive layer 48 and is applied on a side edge portion of the photoreceptor belt 2, to the ground through the chain 49, made of electrically conductive material, via the sprocket wheels. This flexible feeler 55 may be secured to the link 50*a* by means of a fastening screw such as shown in FIG. 5. In both event, any of the chains 45 and 49 which are employed in the present invention is commercially available.

Referring back to FIG. 2, the belt assembly further comprises a suction mechanism 81 arranged within the space occupied by the photoreceptor belt and behind a portion of the photoreceptor belt which is at the exposure or imaging station. This suction mechanism 81 includes a perforated flat plate 82 arranged so as to back up a portion of the belt 2 at the exposure or imaging station and is operable in such a manner that, when a suction fan 84 is operated, air within the suction mechanism 81 is drawn out through said suction fan 84 thereby causing that portion of the photoreceptor belt 2 to be held flat against the perforated flat plate 82. This suction mechanism 81 satisfactorily operates, even if made in a compact size, because the photoreceptor belt 2 employed is very thin, for example, 200 microns in thickness as hereinbefore described.

Referring again to FIGS. 3 and 4, the tension adjusting mechanisms operatively associated with the driven roll 39 will now be described. However, since the tension adjusting mechanisms have the same construction as hereinbefore indicated, only one of said adjusting mechanisms which is located in the side plate 42 will be described for the sake of brevity.

The tension adjusting mechanism comprises a boss 62 rigidly mounted on, or otherwise integrally formed with, the bearing 61*b*, a bracket 63 secured to the side plate 42 adjacent the upper end of the slot 60, an adjustment bolt 64 and a locking nut 65. Adjustment of the tension imparted to the driven roll 39 can be carried out by turning the adjustment bolt 64 in one direction and then fastening the locking nut 65 to lock the adjustment bolt 64, while release of the tension in readiness for replacement of the photoreceptor belt 2 can be carried out first by releasing the locking nut 65 and then turning the adjustment bolt 64 in the opposite direction so as to move the bearing 61*b* and, hence, the driven roll 39 in a direction towards the bracket 63.

While the belt assembly 1 is constructed in the manner as hereinbefore described, at least one of the side plates, which is at a position remote from the access opening of the housing structure 90 when said belt assembly is completely accommodated within said housing structure in a manner which will be described later, that is, the side plate 42, has a shape similar to the cross sectional area occupied by the photoreceptor belt 2, smaller than the imaginary widthwise extension of the photoreceptor belt 2. This is because, as the belt assembly is selectively inserted into or drawn out of the housing structure, the side plate 42 traverses such operating elements as developer 11, corona discharger 9, strip fingers 28, erasing lamp 10, cleaning unit 13 and corona charger 8 without interfering with any of them. Alternatively, both of the side plates 41 and 42 may be made smaller than the imaginary widthwise extension of the photoreceptor belt 2.

Figure 6:
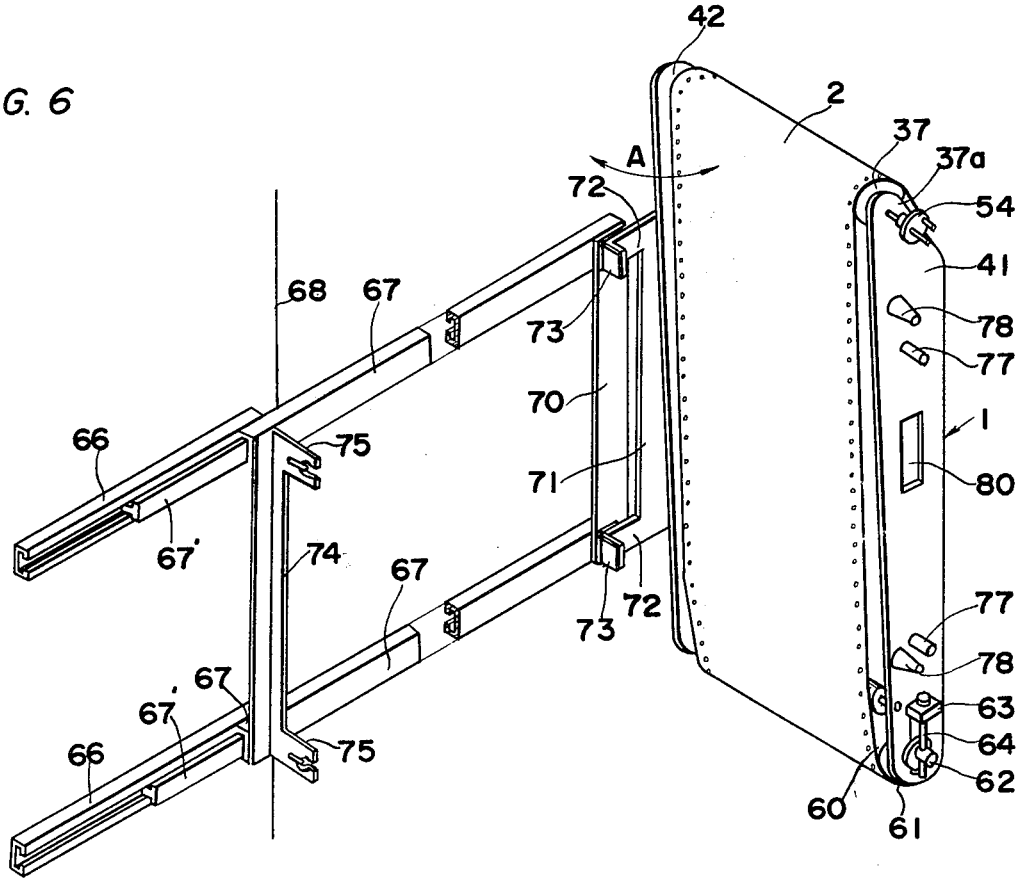
FIG. 6 is a schematic perspective view of the photoreceptor belt assembly and a belt support structure.

The belt assembly 1 having the construction as hereinbefore fully described is telescopically movably supported by the belt support structure having a construction as will now be described with particular reference to FIGS. 4 and 6.

The belt support structure comprises a pair of horizontally extending stationary guide rails 66 secured at least at two spaced points in spaced relation to each other to a framework or a wall 68 forming a part of the housing structure 90, substantially H-sectioned intermediate guide rails 67′ respectively mounted on said stationary guide rails 66 for telescopic movement in a direction parallel to said stationary guide rails 66, and movable guide rails 67 connected to each other by means of mutually spaced connecting plate members 70 and 74 and respectively mounted on the intermediate guide rails 67′ for telescopic movement in parallel relation to the guide rails 67′.

The belt assembly 1 is carried by a mounting plate member 71. This mounting plate member 71 is rigidly secured to the side plate 42 and has a pair of spaced leg portions 72 which are in turn connected to the connecting plate member 70 by means of hinges 73 so that the belt assembly 1 can be pivotable between an operative position and a released position in a direction indicated by the arrow A. The operative position is such that the photoreceptor belt 2 extends in substantially parallel relation to the plane of the mutually connected movable guide rails 67 and, therefore, when said belt assembly 1 is held within the housing structure, that portion of said photoreceptor belt 2, which is at the imaging or exposure station, lies at right angles to the incoming light reflected from the second reflective mirror 6. On the other hand, the released position is such that the photoreceptor belt 2 extends at substantially right angles to the plane of the mutually connected movable guide rails 67 and, hence, each of the rolls 37 to 40 extends at right angles to the lengthwise direction of said movable guide rails 67.

The connecting plate member 74 is provided, or otherwise integrally formed with a pair of spaced elastic clips 75 for receiving therein respective pin members 77, rigidly secured to the side plate 41, to lock the belt assembly 1 in the operative position.

It is to be noted that the side plate 41 is also provided with a pair of pins 78 secured thereto in spaced relation to each other for alignment with respective sockets (not shown), arranged within the housing structure 90, so that, when the belt assembly in the operative position is inserted into the housing structure 90 from the outside thereof, the belt assembly 1 can accurately be positioned relative to the operating elements of the copying machine arranged around the photoreceptor belt 2. In addition, the side plate 41 is formed with an access opening 80 into which the hand of the operator of the machine can be inserted in readiness for pivotal movement of said belt assembly from the operative position to the released position when said belt assembly 1 is drawn out of the housing structure.

As best shown in FIGS. 3 and 4, the side plate 42 is provided with a pair of handles 79 secured thereto in spaced relation to each other. These handles 79 are adapted to receive pulling and pushing forces selectively alternately applied by the operator of the machine when the belt assembly is to be drawn out of and inserted into the housing structure, respectively. It is to be noted that only one handle 79 may suffice depending upon the size of the belt assembly 1.

The belt support structure of the above construction should be designed such that the belt assembly 1 can telescopically be drawn out of and inserted into the housing structure 90 through the access opening of said housing structure and such that, when said belt assembly 1 is within said housing structure, the belt assembly 1 assumes a position where that portion of the photoconductive recording surface of said photoreceptor belt 2 onto which the image of the original to be copied is projected lies at right angles to the incoming light reflected from the second reflective mirror 6 and, when said belt assembly 1 is drawn out of the housing structure 90 with said belt support structure completely extended, it assumes a position substantially clear of the housing structure.

Where replacement of the photoreceptor belt 2 is desired while the belt assembly 1 is held in position within said housing structure 90 with said belt support structure folded, the necessary procedures are first to draw the belt assembly 1 out of the housing structure 90 after the hingedly supported door 91 has been opened and then to loosen the tension adjusting mechanisms thereby permitting the driven roll 39 to move in a direction towards the opposed drive roll 37. The pivotal movement of the belt assembly 1 from the operative position to the released position about the hinges 73 may be effected prior to or after loosening the tension adjusting mechanisms. The slackened photoreceptor belt 2 can at this time be removed from the belt assembly by pulling it across the side plate 41. A fresh photoreceptor belt can be mounted on the belt assembly by following substantially the reverse procedure. The belt assembly with the new photoreceptor belt can also be mounted in position within the housing structure by following a substantially reverse procedure.

Connection between the coupling 54 and a drive mechanism, for example, an electrically operated motor (not shown) which is installed within the housing structure 90 can be automatically achieved. For this purpose, a pin and socket arrangement may be employed. Alternatively, any other suitable coupling system may be employed. However, in any event, a counterpart coupling which is detachably engaged with the coupling 54 on the drive roll 37 and which is in turn coupled to a motor shaft (not shown) of the drive mechanism should be positioned within the housing structure in alignment with the coupling 54 when the belt assembly 1 is inserted into the housing structure 90.

From the foregoing full description of the present invention, it has now become clear that no portion of the belt assembly 1 including the photoreceptor belt 2 interferes with the operating elements of the copying machine during its movement into and out of the housing structure 90. More specifically, since the chain 49 including the feeler 55 and the pins 51 is situated adjacent the side plate which faces the access opening of the housing structure when the belt assembly is held in position within the housing structure, it will not contact such operating elements as the developer 11, the cleaning unit 13 and others, when the belt assembly is being drawn out of the housing structure. On the other hand, the chain 45 including the pins 51 is so disposed adjacent an upper portion of the side plate, which is remote from the access opening of the housing structure 90, that it will not contact any of the operating elements when the belt assembly is being drawn out of the housing structure.

Therefore, it has now become clear that, in the copying machine constructed according to the present invention, more of the operating elements of the copying machine need be retracted so as to avoid a possible interference between some or all of them and the belt assembly.

Although the present invention has been fully described by way of example, it should be noted that various changes and modifications are apparent to those skilled in the art. For example, although in the foregoing illustrated embodiment the photoreceptor belt 2 has been described as suspended around the four rolls 37 to 40, employment of at least a pair of drive and driven rolls 37 and 39 may be sufficient. In addition, instead of employment of the chain drive system, any conventional belt drive system may be employed in which case the perforations 52 and 53 may not be required.

Moreover, in the illustrated embodiment, the belt assembly 1 has been described and illustrated as vertically extending. However, the concept of the present invention can equally be applicable to a copying machine wherein the belt assembly extends substantially horizontally.

Accordingly, these changes and modifications are to be understood as included within the true scope of the present invention unless they depart therefrom.

What is claimed is:

1. A belt support structure in a photoelectrostatic copying machine comprising a housing structure having an access opening in a plane and adapted to be selectively closed and opened, said access opening leading into the interior of said housing structure in which necessary operating elements of the copying machine are arranged, which belt support structure comprises:

a photoreceptor belt assembly including a photoreceptor belt and first and second side plates and a plurality of rolls rotatably supported between said first and second side plates in spaced relation to each other, tension adjusting means for adjustment of tension imparted to said photoreceptor belt, said photoreceptor belt being suspended around said rolls, one of said rolls being adapted to be drivingly coupled to a source of driving force when said belt assembly is inserted into said housing structure, and said first side plate being situated remote from said access opening when said belt assembly is inserted into said housing structure and having alignment elements thereon, counter-alignment elements stationarily held in position within the housing structure and engaged by said alignment elements when said belt assembly is within said housing structure for accurately positioning said belt assembly when the latter is inserted into said housing structure;

stationary guide means rigidly secured at least at two spaced points to a wall member of the housing structure within said housing structure, said stationary guide means extending in a direction substantially intersecting the plane of said access opening;

intermediate guide means telescopically movably mounted on said stationary guide means;

movable guide means telescopically mounted on said intermediate guide means; and hinge means for hingedly mounting said photoreceptor belt assembly on one end portion of said movable guide means for pivotal movement between an operative position, in which the plane of a portion of said photoreceptor belt onto which the incoming light carrying an optical image of an original to be copied is projected lies at right angles to said incoming light when said belt assembly is held in position within said housing structure, and a released position in which said portion of said photoreceptor belt in angularly displaced from the direction of the telescopic movement of said intermediate and movable guide means when said belt assembly is in position outside said housing structure, said belt assembly being selectively drawn out of and inserted into said housing structure with said intermediate and movable guide means fully extended and folded relative to said stationary guide means, respectively.

2. A belt support structure as claimed in claim 1 wherein said first side plate is provided with at least one pin member, and said belt support structure further comprises a clip rigidly carried by said movable guide means, said clip firmly receiving said pin member when said belt assembly is pivoted to said operative position, thereby holding said belt assembly in said operative position.

3. A belt support structure as claimed in claim 1 wherein said second side plate is situated adjacent to said access opening, said first and second side plates having separate access means with which the hand of an operator of the copying machine can be engaged to enable said belt assembly to be pivoted and to be selectively drawn out of and inserted into the housing structure.

4. A belt support structure as claimed in claim 1 wherein said photoreceptor belt has in both side edge portions respective rows of perforations, and a corresponding number of chains on said belt assembly for driving said photoreceptor belt, each having a plurality of engagement pins engageable in said perforations of each row for transmitting a driving force to said photoreceptor belt.

5. A belt support structure as claimed in claim 4 wherein one of said chains is suspended around the rolls around which said photoreceptor belt is suspended and has an electroconductive feeler thereon for constantly connecting the electroconductive layer of the photoreceptor belt to ground.

6. A belt support structure as claimed in claim 5 wherein said electroconductive layer of said photoreceptor belt has an electroconductive coating on a corresponding side edge portion of said photoreceptor belt which is engaged by said feeler.

7. A belt support structure as claimed in claim 5 wherein said feeler includes a fastening screw member securing said feeler to said chain.

* * * * *